US005240155A

United States Patent [19]

Mueller et al.

[11] Patent Number: 5,240,155

[45] Date of Patent: Aug. 31, 1993

[54] CLOSURE WITH INTEGRAL TWIST RING

[75] Inventors: Bruce M. Mueller, Brookfield, Wis.; Eldon W. Schaffer, II, Barrington, Ill.

[73] Assignee: Seaquist Closures, Mukwonago, Wis.

[21] Appl. No.: 831,446

[22] Filed: Feb. 5, 1992

[51] Int. Cl.[5] ..... B67D 3/00

[52] U.S. Cl. ..... 222/519; 222/541; 222/549

[58] Field of Search ..... 222/519, 541, 545, 549; 29/414, 416; 264/318, 328.1; 425/577, DIG. 58

[56] References Cited

U.S. PATENT DOCUMENTS

| | | | |
|---|---|---|---|
| 2,555,047 | 5/1951 | Logue . | |
| 2,582,566 | 1/1952 | Schwimmer et al. . | |
| 3,063,602 | 11/1962 | Anderson . | |
| 3,067,916 | 12/1962 | Lerner | 222/519 |
| 3,198,406 | 8/1965 | Kopelman . | |
| 3,289,725 | 12/1966 | Gehring . | |
| 3,409,710 | 11/1968 | Klygis | 29/416 X |
| 3,876,269 | 4/1975 | Fisher et al. . | |
| 4,541,605 | 9/1985 | Kubota et al. . | |
| 4,544,063 | 10/1985 | Neward | 222/519 X |
| 4,583,667 | 4/1986 | Fishman et al. . | |
| 4,613,063 | 9/1986 | Wright . | |
| 4,649,013 | 3/1987 | Yamamoto et al. . | |
| 4,751,036 | 6/1988 | Barriac . | |
| 4,771,923 | 9/1988 | Zinnbauer . | |
| 4,806,301 | 2/1989 | Conti . | |
| 5,038,967 | 8/1991 | Braun | 222/519 |

OTHER PUBLICATIONS

PCT Notification of Transmittal of the International Search Report or the Declaration for PCT/US92/04462 dated 22 Sep. 1992.

PCT International Search Report for PCT/US92/04462 dated 22 Sep. 1992.

*Primary Examiner*—Gregory L. Huson

*Attorney, Agent, or Firm*—Dressler, Goldsmith, Shore, Sutker & Milnamow, Ltd.

[57] ABSTRACT

A unitary article is provided in a form which can be reconfigured as a two-piece dispensing closure. According to the method, the unitary article is molded with frangible webs connecting a ring to a body so that the ring is axially offset from, but concentric with, the cylindrical wall of the body. Subsequently, the frangible webs are broken, and the ring is moved axially to a location concentric with the body cylindrical wall to form the assembled closure. In the assembled closure the body has a closed end and an open end suitable for mounting on a container. The cylindrical wall of the body defines a discharge passage for communicating with the container for dispensing the contents thereof. The ring defines a dispensing orifice and accommodates rotation between a dispensing position in which the passage and orifice are at least partially aligned and a closed position in which the passage is occluded by the ring.

8 Claims, 2 Drawing Sheets

CLOSURE WITH INTEGRAL TWIST RING

TECHNICAL FIELD

This invention relates to closures for containers and, in particular, to a closure which has a tamper-evident feature that can be readily manufactured as a one-piece article that can be subsequently reconfigured as a two-piece dispensing closure.

BACKGROUND OF THE INVENTION AND TECHNICAL PROBLEMS POSED BY THE PRIOR ART

A variety of container closures have been proposed wherein the closure includes a first portion, body, or base for being mounted to the open end of a container and wherein the closure includes a second portion, such as a cover, that is rotatably mounted on the first portion. The first portion defines a discharge passage, and the cover defines a dispensing orifice. The cover can be rotated between a dispensing position in which the passage and orifice are at least partially aligned and a closed in the which the passage is occluded by the cover. See for example, the U.S. Pat. No. 3 198,406 and No. 4,613,063.

U.S. Pat. No. 3,063,602 discloses a dispensing container in which the sidewall of the container defines a discharge passage and in which a snap-on cap is rotatably mounted on the sidewall to cover the discharge passage. The cap defines a dispensing orifice which can be aligned with the discharge passage to permit the contents of the container to be dispensed.

While the designs disclosed in the above-discussed patents may provide articles that could generally function adequately for their intended purposes it would be desirable to provide an improved closure having a unique design which could be relatively easily manufactured.

Further, it would be advantageous if the manufacture of such an improved closure would require only the single molding of a unitary article rather than the separate molding of a plurality of parts which must be subsequently assembled.

It would also be desirable if the improved closure could be manufactured with a molding process that would accommodate an efficient mold design and a highly efficient manufacturing process.

It would also be beneficial if such an improved closure could be relatively simple to operate for dispensing the contents of a container and yet effectively seal the container when the closure is closed.

The present invention provides an improved closure which can accommodate designs having the above-discussed benefits and features.

SUMMARY OF THE INVENTION

The present invention provides a novel dispensing closure which can be readily manufactured, which is easily operated to dispense the contents, and which provides a highly effective seal when the closure is closed.

One form of the invention is a unitary article that can be reconfigured as a two-piece dispensing closure. The unitary article has a body having a closed end and an open end suitable for mounting on a container. At least a portion of the body has a wall defining a discharge passage for communicating with the container for dispensing the contents thereof.

A ring is connected with frangible means (e.g., a thin, continuous web or a plurality of small, spaced-apart, bridging webs) to the body wall in an orientation axially offset from the body wall. The ring defines a dispensing orifice.

The frangible means can be broken, and the ring can be moved axially to a location around the body wall. This accommodates rotation of the ring between a dispensing position in which the passage and orifice are at least partially aligned and a closed position in which the passage is occluded by the ring.

The present invention may also be characterized as a product in the form of a dispensing closure made in accordance with a unique process. That process includes molding the above-described unitary article so that the ring and body are axially offset and connected together with frangible means extending between the body wall and ring.

The process by which the article is made further includes the step of breaking the frangible means and moving the ring axially to a location around the body wall so as to accommodate rotation between a dispensing position in which the passage and orifice are at least partially aligned and a closed position in which the passage is occluded by the ring.

The present invention also includes the above-described process for fabricating the unique closure. Further, the invention contemplates a preferred form of the novel process which employs upper and lower mold cores cooperating with two sections of a split-cavity mold. In particular, the upper mold core is positioned so that it is spaced from the lower mold core within the split-cavity mold. A thermoplastic molding composition is then injected into the mold sections around the upper and lower mold cores to mold a unitary article. The unitary article includes two main portions:

(1) a body having (a) a closed end defined between the upper and lower mold cores, (b) an open end around the lower mold core for mounting on a container, and (c) a wall around a lower mold core defining a discharge passage for communicating with the container for dispensing the contents thereof;

(2) a ring that (a) is located around the upper mold core, (b) is connected with frangible means to the body wall in an orientation axially offset from the body wall, and (c) defines a dispensing orifice.

After molding the above-described unitary article, the mold sections are opened, and the upper mold core is withdrawn from the ring. Then the lower mold core is removed from the body, and the ring is moved axially relative to the body to break the frangible means and locate the ring on the body wall for rotation around the body wall. The discharge passage can thus be selectively opened by at least partially aligning the discharge passage and the dispensing orifice.

In this molding method, the frangible means may be broken and the ring may be moved relative to the body after the lower mold core is removed from the body. Alternatively, the frangible means may be broken and the ring moved relative to the body before the lower mold core is removed from the body.

If the frangible means is not broken and the unitary article is removed from the lower mold core with the integrity of the frangible means maintained, then the unitary article may be moved to another work station, or even shipped to an end user, where the frangible means may be broken and the ring moved into position around the body.

The method of the present invention accommodates an efficient mold design and efficient manufacturing techniques.

In the preferred form of the method, a unitary article can be molded and then reconfigured into the closure at the mold, and this requires no ancillary equipment.

Further, because the mating components of the closure are manufactured simultaneously in a mold assembly, the mating components of the assembled closure are more likely to have a better cooperative engagement and fit within the selected design tolerances, and the performance of the closure, with respect to sealability, etc., is more likely to be more reliable.

In a preferred form of the closure, either the body wall or ring defines one or more grooves (such as a pair of axially spaced-apart grooves) while the other defines one or more projections (such as a pair of spaced-apart beads) for being received in the grooves. The grooves and projections extend at least partially in a circular configuration. The body further defines an outwardly projecting sealing lip around the discharge passage for sealing against the ring. Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

Figure 1:
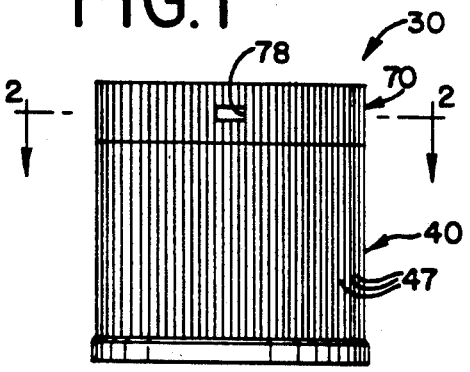
FIG. 1 is a front, elevational view of the assembled closure of the present invention shown with the dispensing orifice aligned with the discharge passage to establish an "open" condition of the closure for dispensing the contents of a container on which the closure can be mounted.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in a normal (upright) storage position, and terms such as upper, lower, horizontal, etc., are used with reference to this position. It will be understood, however, that the closure of this invention may be manufactured, stored, transported, used, and sold in an orientation other than the position described.

Some of the figures illustrating the closure show structural details and mechanical elements that will be recognized by one skilled in the art. However, the detailed descriptions of such elements are not necessary to an understanding of the invention, and accordingly, are not herein presented.

A first form of the closure of the present invention is designated generally in FIGS. 1–7 by reference numeral 30, and the closure 30 is adapted to be mounted on a container (not shown). The container may be of any suitable special or conventional type and typically has a neck which receives the closure 30 and which defines an opening through which the container contents can be dispensed.

Figure 3:
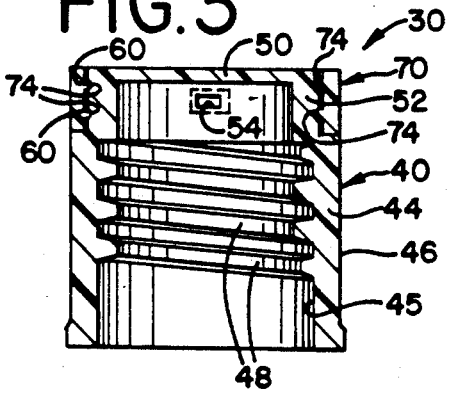
FIG. 3. is a cross-sectional view taken generally along the plane 3—3 in FIG. 2.

As best illustrated in FIG. 3, the closure 30 includes a housing, base, or body 40 for securement to the container. The closure body 40 includes a peripheral wall in the form of a generally cylindrical wall or skirt 44 which has an interior surface 45 and an exterior surface 46 (FIG. 3). The exterior surface of 46 of the closure body skirt 44 as shown is provided with a plurality of vertically oriented, V-shaped ribs 47 (FIG. 1). However, the surface 46 may also be smooth without in any way affecting the function of the closure.

The skirt 44 includes a conventional thread 48 or other suitable means (e.g., a snap-fit bead (not illustrated)) for engaging a suitable cooperating means, such as a mating thread, on the container neck to secure the closure body 40 to the container.

As best illustrated in FIG. 3 the closure body 40 includes a deck structure or top wall 50. The deck or wall 50 defines a closed end on the body 40 opposite the open end.

Figure 4:
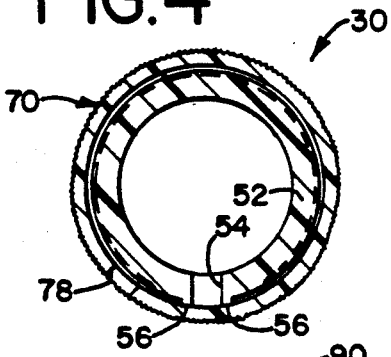
FIG. 4 is a cross-sectional view similar to FIG. 2 but showing the ring in a moved position to occlude the closure body discharge passage and establish a "closed" condition of the closure.
Figure 5:
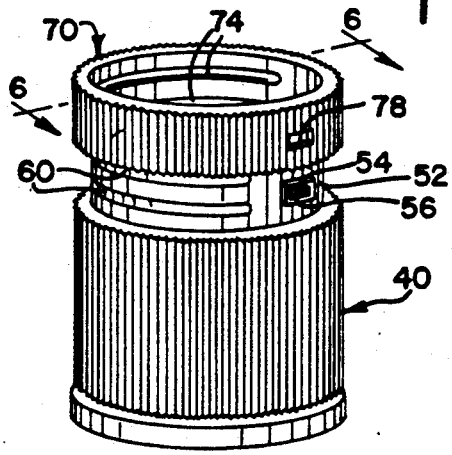
FIG. 5 is a perspective view of a molded, unitary article that can be reconfigured as the two-piece dispensing closure illustrated in FIGS. 1–4.

The portion of the body 40 between the end wall 50 and the threads 48 may be characterized as a generally cylindrical wall 52 (FIG. 3), and the wall 52 defines a discharge passage 54 which extends completely through the wall 52. As best illustrated in FIGS. 4 and 5, the wall 52 also includes an outwardly projecting sealing lip 56 which extends around the discharge passage 52 in a generally rectangular configuration.

The cylindrical wall 52 also defines a pair of spaced-apart grooves 60 which each extend partially in a circular configuration around the wall 52. There is a particular axial relationship between the groove 60 and the lip 56. Specifically, the grooves 60 are axially located and spaced-apart so that the lip 56 is at axial position that is between the grooves 60. However, the grooves preferably do not extend circumferentially completely around the wall 52. The grooves 60 each terminate at a circumferential location which is spaced somewhat from each end of the lip 56.

A twist ring 70 is disposed in concentric relationship with the cylindrical wall 52 as illustrated in FIGS. 1–4. The ring 70 likewise includes a pair of axially spaced-apart, interrupted protuberances, flanges, or beads 74 (FIG. 3) which are each received in one of the grooves 60 in the cylindrical wall 52. This arrangement permits the ring 70 to be rotated about the longitudinal axis of the closure 30 in either of the two directions of rotation.

Figure 2:
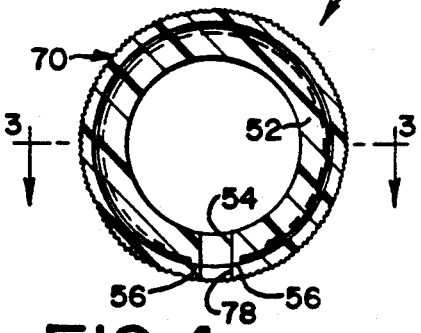
FIG. 2 is a cross-sectional view taken generally along the plane 2—2 in FIG. 1.

The ring 70 also defines a dispensing orifice 78 as best illustrated in FIGS. 1, 2, 4 and 5. In FIGS. 1 and 2, the twist ring 70 is positioned so that the dispensing orifice 78 is aligned with body discharge passage 54. In this orientation, the closure 30 may be said to be "open" for permitting the contents of the container to be dispensed through the closure.

FIG. 4 illustrates the ring 70 rotated to a position in which the dispensing orifice 78 is moved out of alignment with the discharge passage 54 so that a portion of the ring 70 occludes the discharge passage 54. In this respect, it will be appreciated that the outwardly projecting lip 56 surrounding the discharge passage 54 provides an effective seal against the inner surface of the ring 70.

Preferably, the protuberances 74 on the inside of the ring 70 each have a circumferential arc length which is somewhat shorter than the arc length of the receiving groove 60 in the closure body 40. This permits the ring 70 to be rotated in one direction or the other so as to move the dispensing orifice 78 completely away from the discharge passage 54. However, the end of each protuberance 74 on the ring 70 eventually engages the end of the receiving groove 60, and this functions as a stop which prevents further rotation of the ring in that direction.

The cooperating grooves 60 and protuberances 74 on the body 40 and ring 70, respectively, may be reversed so that the grooves would be defined in the ring 70, and the protuberances would be defined on the body 40. Also, other engagement structures could be provided. For example, the ring 70 could be provided with one, wide groove for receiving the lip 56. The wide groove in the ring would extend past the dispensing orifice 78. This would permit rotation of the ring 70 to align the orifice 78 with the body discharge passage 54 while the lip 56 is engaged within the ring groove.

The body wall 52 and ring 70 are illustrated as each being generally cylindrical in the preferred embodiment. It will be appreciated, however, that the wall 52 and ring 70 may each have other mating configurations that accommodate rotation, such as a frustoconical configuration.

In the preferred form illustrated, the two-piece closure 30 can be fabricated in a unique and highly efficient manner. In particular, a unitary article is first molded in a form that can be subsequently reconfigured as the two-piece dispensing closure. The unitary article is illustrated in FIGS. 5–7, and the unitary article includes the connected to the closure body cylindrical wall 52 by frangible means such as a plurality of spaced-apart frangible webs 80.

Figure 6:
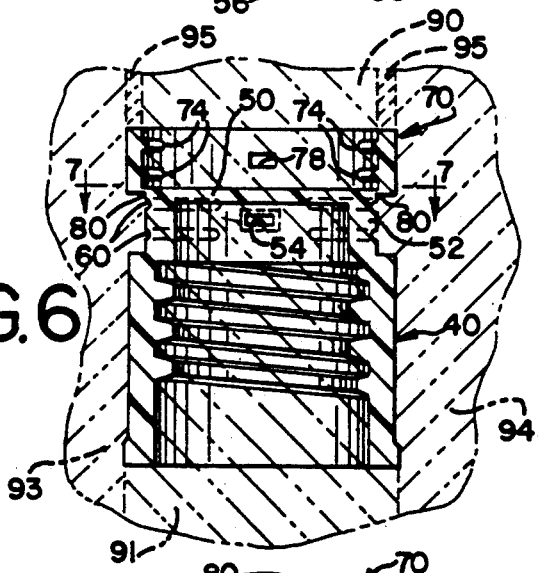
FIG. 6 is a cross-sectional view taken generally along the plane 6—6 in FIG. 5 and also shows, in phantom with dashed lines, a mold assembly in which the unitary article is molded.
Figure 7:
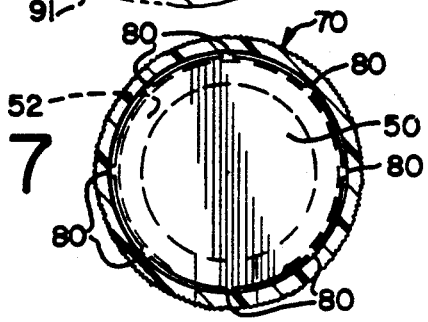
FIG. 7 is a cross-sectional view generally along the plane 7—7 in FIG. 6.

As illustrated in FIG. 6, the ring 70 is oriented concentric with, but axially offset from, the body cylindrical wall 52. Subsequently, axially directed forces are applied to the closure body 40 and ring 70 so as to break or rupture the frangible webs 80 and so as to effect relative axial movement between the ring 70 and closure body 40 so that the ring 70 becomes disposed on the closure body cylindrical wall 52.

When properly positioned, the protuberances 74 of the ring 70 are received within the grooves 60 of the closure body cylindrical wall 52. The structure of the ring 70 is sufficiently deflectable and resilient so as to accommodate the axial movement of the protuberances 74 past the closure body top end wall 50 and into the grooves 60.

As shown in FIG. 6, a preferred form of the method of fabricating the closure employs an upper mold core 90 along with a stripper ring 95. These cooperate with a lower mold core 91 within a first section 93 and a second section 94 of a closed, split-cavity mold. The upper mold core 90 and stripper ring 95 are initially spaced from the lower mold core 91. The two sections 93, 94 of the split-cavity mold are closed about the lower mold core 91, upper mold core 90, and stripper ring 95.

A thermoplastic molding composition is injected into the mold sections around the upper and lower mold cores. The external details and external features of the ring 70 and closure body 40 are formed by the two split-cavity mold halves 93, 94. The interior details of the ring 70 are formed by the upper mold core 90, and the interior details of the closure body 40 are formed by the lower mold core 91. The top wall 50 of the closure body 40 is formed between the end of the upper mold core 90 and the end of the lower mold core 91. The frangible webs 80 are formed between the edge of the end of the upper mold core 90 and the two, split-cavity mold halves or sections 93, 94.

After the unitary article is molded in the configuration shown in FIGS. 5–7, the split-cavity mold sections 93, 94 are opened. The upper mold core 90 is then withdrawn from the ring 70.

Next, the lower mold core 91 is removed from the closure body 40 while the ring 70 is moved by the stripper ring 95 relative to the body 40 to break the frangible webs and locate the ring 70 concentric with the body 70 cylindrical wall 52.

The frangible webs may be broken, and the ring moved onto the body 40, before the lower mold core 91 is removed from the body 40.

Alternatively, the lower mold core 91 may be removed from the closure body 40 with the ring 70 attached in the axially offset position by the frangible webs 80. The unitary structure may then be taken to a separate processing station, or shipped to an end user, for subsequent breaking of the frangible webs 80 and repositioning of the ring 70 around the closure body cylindrical wall 52.

The method for making the closure can be accomplished with a single mold assembly, and a preferred form of the method can be effected without ancillary equipment. This provides improved production efficiency.

Further, because the mating components are manufactured simultaneously, there is a greater likelihood that, within any selected range of manufacturing tolerances, the operation of the closure will be more reliable.

Figure 8:
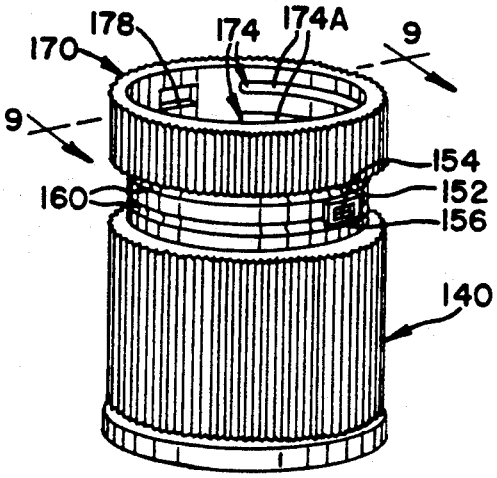
FIG. 8 is a view similar to FIG. 5 but shows an alternate form of a molded, unitary article of the present invention which can be reconfigured as a two-piece dispensing closure.
Figure 9:
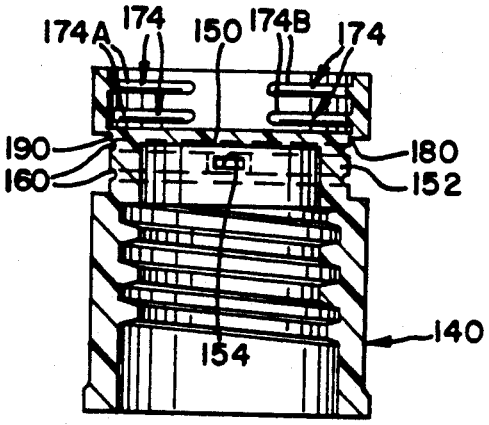
FIG. 9 is a cross-sectional view taken generally along the plane 9—9 in FIG. 8.

A preferred arrangement of the dispensing orifice and discharge passage in the molded, unitary article is illustrated in FIGS. 8 and 9 as an alternate embodiment. The unitary article is designated in FIGS. 8 and 9 generally by the reference numeral 131 and is similar in many respects to the unitary article illustrated in FIG. 5.

The unitary article 131 shown in FIG. 8 includes a closure body 140 having an upper cylindrical wall 152 defining outwardly open, axially spaced-apart grooves 160, a discharge passage 154, and a surrounding lip 156. These structures, with the exception of the grooves 160, are identical to the corresponding structures of the FIG. 5 embodiment described above.

The elements of the embodiment of the article 131 illustrated in FIGS. 8 and 9 are designated by reference numbers in the 100 series. Those elements of the FIGS. 8 and 9 embodiment which are identical or functionally analogous to elements of the FIG. 5 embodiment are designated by 100 series reference numbers in which the last two digits are identical to the two digit reference numbers employed in designating the identical or analogous elements of the FIG. 5 embodiment.

Each groove 160 in the article 131 extends completely around the cylindrical wall 152. The discharge passage 154 and lips 156 lie between the grooves 160. This contrasts with the FIG. 5 embodiment wherein the grooves 60 terminate on each end of the discharge passage 54.

The unitary article 131 illustrated in FIGS. 8 and 9 also includes a ring 170 which is molded as a unitary extension of the base 140. To this end, the ring 170 and base 140 are connected by a suitable frangible means 180, such as a thin film frangible web or a plurality of circumferentially spaced-apart frangible webs.

The ring 170 defines a dispensing orifice 178. Unlike the embodiment illustrated in FIGS. 1–7, the orifice 178 in the article 131 illustrated in FIGS. 8 and 9 is located at a position about 180° from the base discharge passage 154.

The ring 170 also includes inwardly projecting beads 174. The beads 174 are axially spaced-apart and are adapted to each be received in one of the grooves 160 in the base 140. Each bead 174 is interrupted at a location opposite the body discharge passage 154 to define two separated bead portions, 174A and 174B. This interruption of the beads 174 permits the ring 170 to be moved axially downwardly onto the body cylindrical wall 152 while the spacing between the bead portions 174A and 174B accommodates the outwardly projecting lip 156 around the body discharge passage 154.

When the ring 170 is pushed downwardly onto the body 140, the frangible means 180 is broken, and the closure is in a "closed" condition wherein the ring dispensing orifice 178 is 180°0 from the body discharge passage 154. In this condition, the portion of the ring 180° opposite the ring dispensing orifice 178 lies in front of the body dispensing orifice 154, and the dispensing orifice lip 156 sealingly engages the inside surface of the ring 170 so that the discharge passage 154 is sealingly occluded.

The assembled closure, with the ring 170 pushed down on the closure body 140 in the closed condition, may then be applied to the neck of a container (not illustrated). Typically, the closure would be applied by a product packager to a new container containing a product suitable for dispensing through the closure when a user subsequently rotates the ring 170 to an open configuration in which the ring dispensing orifice 178 is at least partially aligned with the body discharge passage 154.

Another aspect of the invention relates to modifications that may be made to the structure of the discharge passage 54 or 154, dispensing orifice 78 or 178, grooves 60 or 160, and mating projections 74 or 174. In particular, the discharge passage 54 or 154, and dispensing orifice 78 or 178, may have configurations other than the rectangular configuration illustrated. For example, both the passage 54 or 154, and orifice 78 or 178, could be circular.

In addition, in some applications, it may be desirable to provide the body with only one groove rather than two spaced-apart grooves 60 or 160. In such a situation, only one mating projection 74 or 174 would be provided. The single groove and single projection could be disposed generally axially above the discharge passage or axially below the discharge passage. If a single, upper groove 160 were used in the embodiment shown in FIGS. 8 and 9, then single, mating, upper bead 174 could be provided without an interruption 180° opposite the dispensing orifice 178.

Further, in another form of the invention, a single body groove and single mating ring bead could each be provided as partial circular arcs having predetermined arc lengths with the arc length of the bead being less than the arc length of the groove. Both the groove and bead could be circumferentially located in a manner that would accommodate placement of the groove and bead structure at about the same axial location as the discharge passage.

It will also be appreciated that the frangible connecting means may have a variety of configurations different from the illustrated frangible connecting means 80 or 180 which consist of a plurality of spaced-apart, frangible webs 80. In particular, a thin, continuous, frangible web could be employed as well as other functionally analogous structures. Further, the web or webs could be disposed relative to the closure longitudinal axis in axially or radial orientations as well as at oblique angles relative to the longitudinal axis.

According to another aspect of the invention, the novel two-piece closure could be fabricated by molding the body 40 or 140 and ring 70 or 170 separately in different molds. Subsequently, the two parts could be assembled. This process could be used even where only one groove 60 or 160 and mating bead 74 or 174 are employed in conjunction with the dispensing orifice 54 or 154 having a lip 56 or 156 for sealing against the ring 70 or 170.

It will readily apparent from the foregoing detailed description of the invention and from the illustrations thereof that numerous other variations and modifications may be effected without departing from the true spirit and scope of the novel concepts or principles of this invention.

What is claimed is:

1. A unitary article that can be reconfigured as a two-piece dispensing closure, said article comprising:

a body having a closed end and an open end suitable for mounting on a container, at least a portion of said body having a generally cylindrical wall defining a discharge passage for communicating with said container for dispensing the contents thereof; and a ring and frangible means for connecting said ring to said body wall in an orientation axially offset from said body wall, said ring defining a dispensing orifice whereby said frangible means can be broken to detach said ring from said body wall and said ring can be moved axially to a location around said body wall to accommodate rotation of said ring between a dispensing position in which said passage and orifice are at least partially aligned and a closed position in which said passage is occluded by said ring.

2. The unitary article in accordance with claim 1 in which said frangible means includes a plurality of frangible webs which are circumferentially spaced at equal arc lengths around said body wall.

3. The unitary article in accordance with claim 1 in which said body wall is generally cylindrical and defines two space-apart grooves each extending in at least a partial circular configuration; and said ring is generally cylindrical and defines a pair of spaced-apart protuberances for each being received in one of said grooves.

4. The unitary article in accordance with claim 1 in which said body defines an outwardly projecting lip around said discharge passage.

5. A dispensing closure comprising:

a body having a closed end and an open end suitable for mounting on a container, at least a portion of said body having a wall defining a discharge passage for communicating with said container for dispensing the contents thereof; and a ring disposed around said body wall, said ring defining a dispensing orifice and accommodating rotation between a dispensing position in which said passage and orifice are at least partially aligned and a closed position in which said passage is occluded by said ring;

one of said body wall and ring defining a pair of spaced-apart grooves which extend only partially into the thickness of said body wall or ring to eliminate potential leakage paths and the other of said body wall and ring defining a pair of spaced-apart projections for being received in said grooves, said grooves and projections each extending in at least a partial circular configuration, said body further defining an outwardly projecting sealing lip protruding around said discharge passage for sealing against said ring to provide a liquid-tight seal, sad lip being located axially intermediate said grooves and projections.

6. The closure in accordance with claim 5 in which said dispensing orifice and said discharge passage each have a generally rectangular configuration.

7. A dispensing closure comprising:

a body having a closed end and an open end suitable for mounting on a container, at least a portion of said body having a wall defining a discharge passage for communicating with said container for dispensing the contents thereof; and a ring disposed around said body wall, said ring defining a dispensing orifice and accommodating rotation between a dispensing position in which said passage and orifice are at least partially aligned and a closed position in which said passage is occluded by said ring;

one of said body wall and ring defining at least one groove which extends only partially into the thickness of said body wall or ring to eliminate a potential leakage path and the other of said body wa and ring defining at least one projection for being received in said groove, said groove and projection each extending in at least a partial circular configuration, said body further defining an outwardly projecting sealing lip protruding around said discharge passage for sealing against said ring to provide a liquid-tight seal.

8. The closure in accordance with claim 7 in which said body wall defines a pair of spaced-apart grooves;

said ring defines a pair of spaced-apart projections each received in one of said grooves; and said lip is located axially intermediate said grooves and projections.

* * * * *

UNITED STATES PATENT AND TRADEMARK OFFICE

CERTIFICATE OF CORRECTION

PATENT NO. : 5,240,155

DATED : August 31, 1993

INVENTOR(S) : Bruce M. Mueller, and Eldon W. Schaffer, II

It is certified that error appears in the above-indentified patent and that said Letters Patent is hereby corrected as shown below:

Column 5, line 53, before "connected" insert --twist ring 70--.

Column 7, line 41, after "180°" delete "0".

Column 9, line 35, "sad" should be --said--.

Column 10, line 21, "wa" should be --wall--.

Signed and Sealed this

Twenty-first Day of March, 1995

*Attest:*

*Attesting Officer*

BRUCE LEHMAN

*Commissioner of Patents and Trademarks*